US007328902B1

(12) United States Patent
White et al.

(10) Patent No.: US 7,328,902 B1
(45) Date of Patent: Feb. 12, 2008

(54) TARGET APPARATUS FOR BOLA TOSS GAME

(76) Inventors: David W. White, 2241 E. Logan St., Republic, MO (US) 65738; Shelley M. White, 2241 E. Logan St., Republic, MO (US) 65738

( * ) Notice: Subject to any disclaimer, the term of this patent is extended or adjusted under 35 U.S.C. 154(b) by 118 days.

(21) Appl. No.: 11/282,919

(22) Filed: Nov. 18, 2005

(51) Int. Cl.
*A63B 67/00* (2006.01)

(52) U.S. Cl. ..... 273/343

(58) Field of Classification Search ..... 273/343, 273/348, 317; 211/95, 105.1, 164, 182
See application file for complete search history.

(56) References Cited

U.S. PATENT DOCUMENTS

| | | | | |
|---|---|---|---|---|
| 141,064 | A * | 7/1873 | McMahon | 211/164 |
| 2,797,924 | A | 7/1957 | Stewart | |
| 3,685,826 | A | 8/1972 | Lehman | |
| 3,717,348 | A | 2/1973 | Bowers | |
| 5,165,694 | A | 11/1992 | Kraushaar | |
| 5,522,597 | A | 6/1996 | Hanks | |
| 6,308,956 | B1 | 10/2001 | Reid | |
| 6,773,014 | B2 | 8/2004 | Lynch | |
| 6,773,015 | B2 * | 8/2004 | Long et al. | 273/343 |
| 6,808,175 | B1 * | 10/2004 | Gleeson | 273/343 |
| 6,889,982 | B1 | 5/2005 | Gove | |
| 7,004,468 | B2 * | 2/2006 | Johnson et al. | 273/343 |
| 7,134,661 | B2 * | 11/2006 | Trecartin | 273/343 |
| 7,198,273 | B1 * | 4/2007 | Advocate | 273/343 |
| 2002/0084588 | A1 * | 7/2002 | Lynch | 273/343 |
| 2002/0125644 | A1 | 9/2002 | Knudson | 273/398 |
| 2003/0098545 | A1 * | 5/2003 | Webb | 273/343 |
| 2004/0135318 | A1 * | 7/2004 | Long et al. | 273/343 |
| 2005/0017455 | A1 * | 1/2005 | Long et al. | 273/343 |
| 2005/0077682 | A1 * | 4/2005 | Trecartin | 273/343 |
| 2005/0082761 | A1 * | 4/2005 | Lynch | 273/343 |
| 2005/0116420 | A1 * | 6/2005 | Burgett | 273/343 |
| 2005/0134000 | A1 * | 6/2005 | Johnson et al. | 273/343 |
| 2005/0269784 | A1 * | 12/2005 | Peters | 273/343 |
| 2006/0055116 | A1 * | 3/2006 | Senecal | 273/343 |
| 2006/0125184 | A1 * | 6/2006 | Benson | 273/343 |
| 2007/0035093 | A1 * | 2/2007 | Fuchs | 273/343 |

* cited by examiner

*Primary Examiner*—Raleigh W. Chiu
(74) *Attorney, Agent, or Firm*—Jonathan A. Bay

(57) ABSTRACT

A target apparatus for bola tossing games has both a forward and rearward frame presenting one or more rung-targets as well as a construction for the rung-targets by which such have free-spinning outer sleeves. Wherein the spacing between the forward and rearward changes the complexion of bola tossing games by adding a depth dimension among various ones of the rung-targets. And wherein the free-spinning aspect of the rung-targets increases the level of difficulty and skill in perching bolas, either wrapped or draped, at rest on rungs by not only increasing the propensity of landing bolas to, in quick succession, wind fully in and then on rebound unwind and thereafter self-launch off the subject rung but also by increasing the propensity that the foregoing dislodges any previously perched bola.

14 Claims, 3 Drawing Sheets

40
10
III
III
60
22
70,72
24
50
30
54
70,72
52
20
60

TARGET APPARATUS FOR BOLA TOSS GAME

BACKGROUND AND SUMMARY OF THE INVENTION

The invention relates to aerial projectile games and, more particularly, to target apparatus for games with hooking or draping projectiles (eg., bolas).

Briefly, a bola can be reckoned as either a cord with weights (eg., balls) attached to the ends or else—alternatively, and from the perspective not of the cord but of the weights—a pair of weights (eg., balls) secured by a common tether.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
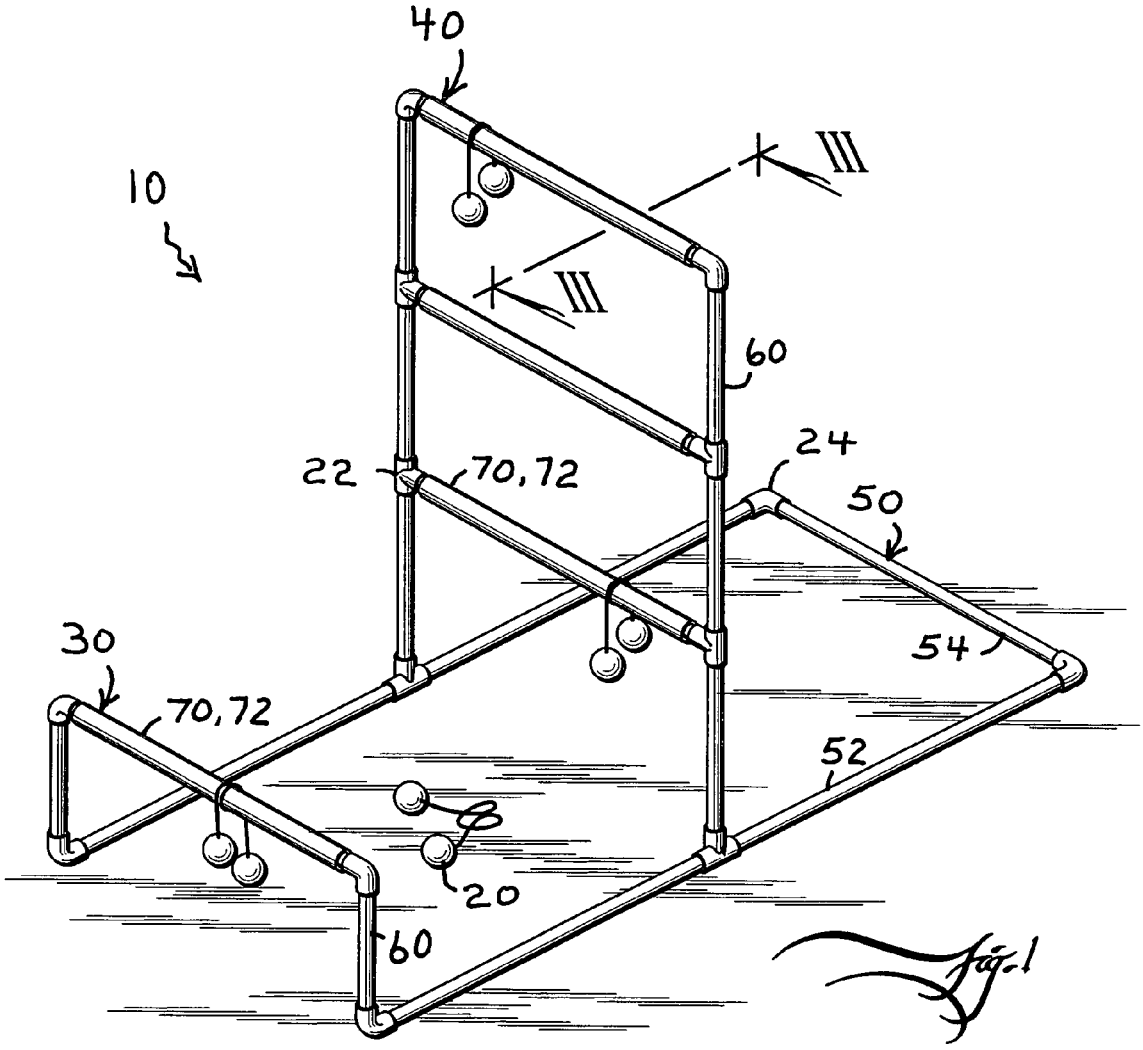
FIG. 1 is a perspective view of a target apparatus in accordance with the invention for a bola toss game.
Figure 2:
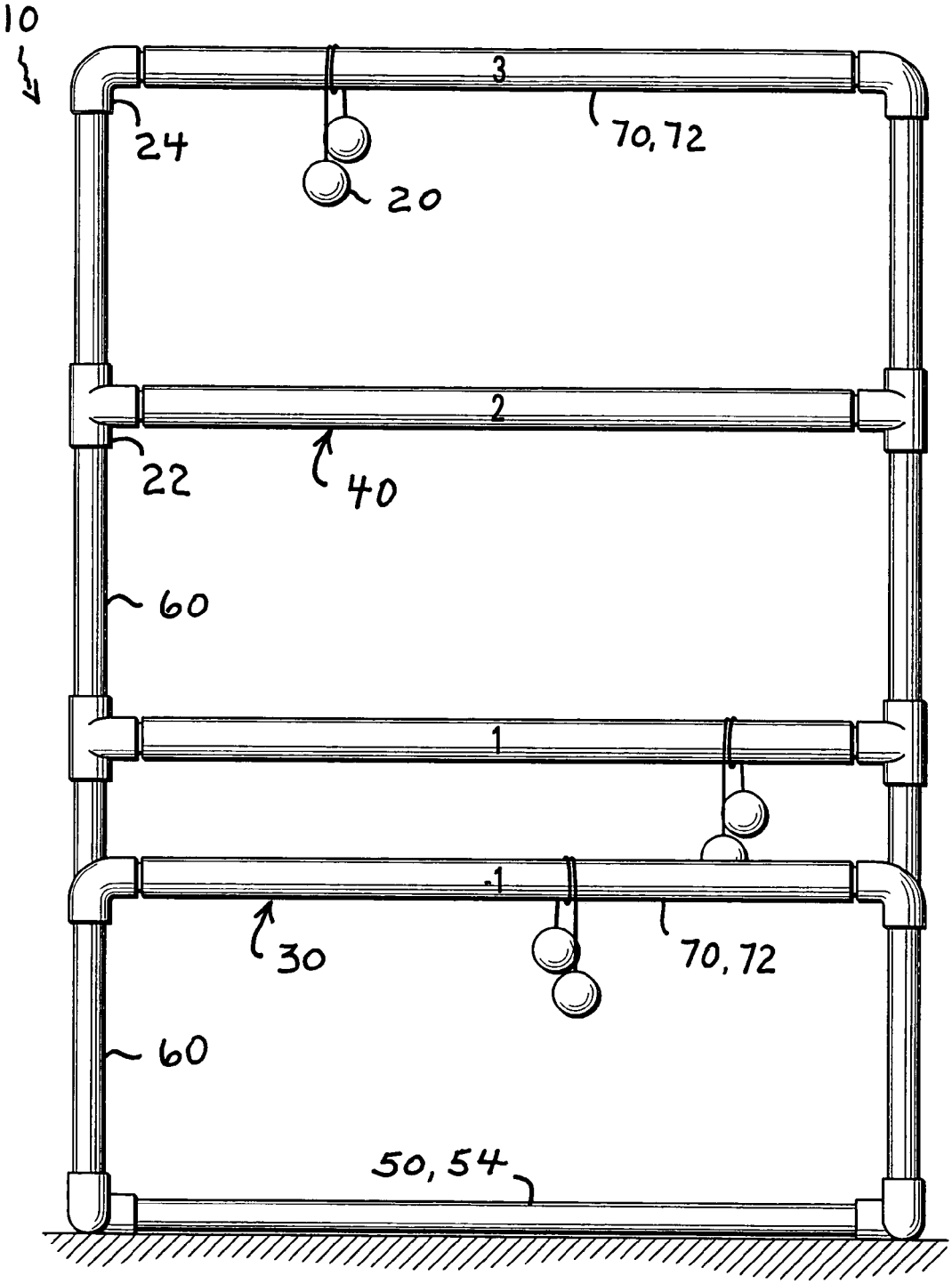
FIG. 2 is an enlarged scale front elevational view thereof.

FIGS. 1 and 2 show a target apparatus 10 for games of tossing bolas 20. Preferably the target apparatus 10 is constructed of slender rod or tubular members held together by fittings comprising a variety of Tees 22 and Ells 24. Suitable materials for both the slender rod or tubular members as well as the fitting 22 and/or 24 therefor include without limitation suitable synthetic or plastic materials including in particular polyvinyl chloride (hereinafter "PVC") pipes (or tubes) and fitting 22 and/or 24. Such a construction is lightweight, sturdy, economical, and easily fixed together by widely available off-the-shelf adhesives or other bonding compositions.

Briefly, the target apparatus 10 comprises a forward frame 30 (eg., "forward" being relative the line of sight from players viewpoint from where they presumptively stand to toss bolas 20), a rearward frame 40, and a support structure 50 comprising a generally horizontal framework (eg., 50) for setting on a base support surface (eg., the ground, or other playing surface).

The horizontal framework 50 comprises a pair of left and right runners 52 tied together at their back ends by a cross piece 54, stabilized at their fronts ends by the forward frame 30, and supporting in the middles thereof the rearward frame 40.

Each frame 30 and 40 comprises a pair of transversely-spaced upright stiles 60. The forward pair of stiles 60 carry at a relatively low elevation at least a top rung 70 extending transversely therebetween. Hence the forward frame 30 is configured generally like a hurdle. Conversely, the rearward pair of stiles 60 preferably carries a plurality of transverse rungs 70 at diverse elevations, including a top rung 70 and one or more intermediate rungs 70. Hence the rearward frame 40 is configured generally like a ladder. FIG. 2 shows best by way of non-limiting example that the top (sole) rung 70 of the forward frame 30 is the lowest rung 70 of all the rungs 70. Conventionally, games of bola toss determine scores based on whether at the end of regulation play any bolas 20 remain perched or not (either by wrapping or draping) on any rungs 70. Hence the rungs 70 are the ultimate targets, and are herein variously referred to as "rung-targets."

It is one aspect of the invention that the spacing between the forward and rearward frames 30 and 40 along the axis of the players' line-of-sight changes the complexion of prior art bola tossing games by adding a depth dimension to different rung-targets 70.

It is an altogether different aspect of the invention that the rung-targets 70 are inventively configured for spinning freely about transverse spin axes, which in general correspond to their axes of symmetry. That way, the free-spinning rung-targets 70 are granted considerable freedom to respond to (in particular, asymmetric) landings of tossed bolas 20 by accelerating to spinning rapidly along the respective spin axis therefor. In consequence, the free-spinning rung-targets 70 increase the level of difficulty and skill in perching bolas 20 (either wrapped or draped at rest) on rungs 70 by not only increasing the propensity of landing bolas 20 to, in quick succession, wind fully in and then on rebound unwind and thereafter self-launch off the subject rung 70 but also by increasing the propensity that the foregoing dislodges any previously perched bola 20.

Figure 3:
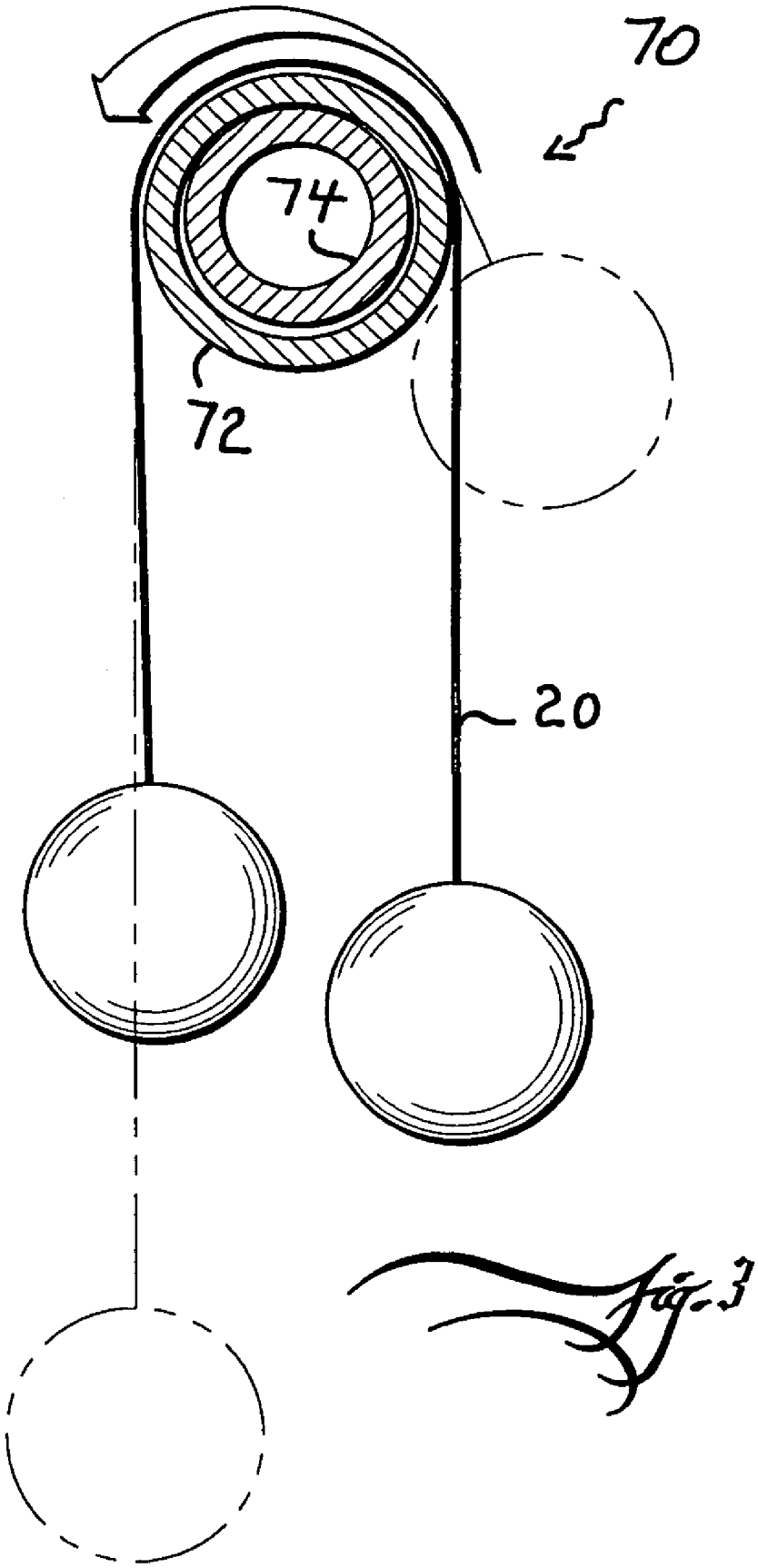
FIG. 3 is an enlarged scale sectional view of taken along the line III-III of FIG. 1.

With general reference to FIGS. 2 and 3, the free-spinning rung-targets 70 comprise free-spinning outer sleeves 72 and inner axles 74 fixed to the stiles 60 therefor, for the outer sleeves 72 to be coupled free-spinning thereon. It is preferred if the both the inner axles 74 and outer sleeves 72 comprise PVC tubes or pipes. More preferred still is a construction whereby the inner axles 74 have a given outside diameter (say, eg., three-fourths inches or ~1.9 cm) such that Tee 22 and Ell 24 fittings therefor provide an outside sleeve diameter (eg., one-inch or 2.54 cm) that matches the outside diameter of the free-spinning sleeve 72 (again, one-inch or 2.54 cm). That way, the contour extending across the outer sleeve 72 to the bracketing fitting 22 and/or 24 therefor is smooth, in that both have (about) the same outside diameter. Again, as FIG. 2 shows best, each outer sleeve 72 and the pair of opposing fitting 22 and/or 24 bracketing it are matched in outside diameter so that there is a smooth continuation of contour therebetween.

Preferably the outer sleeves 72 are sized to fit snugly between the bracketing fitting 22 and/or 24 therefor in order to restrict axial dislocation of the outer sleeve 72, but not so snugly as to add frictional drag. As FIG. 3 shows better, the same design considerations apply to matching the outer sleeve 72's inside diameter to the inner axle 74's outside diameter. The coupling therebetween is desired to be snug but not otherwise introduce a lot of unwanted frictional drag. Again, PVC among other suitable materials is relatively slippery stuff such that the outer sleeves 72 can really accelerate rapidly when impacted by landing bolas 20 to high speeds of spinning.

Generally, when a bola 20 lands on a rung-target 70, it most often wraps itself around the rung 70 with the opposite balls being reeled in closer and closer to the rung 70 until they are finally reeled in to the fullest. At that point, the balls rebound and unwind. Typically the result of this is that the balls cause the bola 20 to self-launch itself completely off the first rung 70 it lands on. (In contrast, it is a less common experience that the bola 20 well re-wind itself on the same rung 70, perhaps another time or two, until it expends all its energy and comes to rest perched on that rung 70.) Anything can happen after that, including that the bola 20 can cascade onto other rungs 70, and so on, until eventually all its energy is expended and it either is perched on one or another rungs 70 or else has fallen to the ground.

When a flying bola 20 lands on and sets to spinning any impacted rung 70, the inventive free-spinning aspect of the rungs 70 is also more likely to cause the dislodgement if not forcible ejection of any previously perched bolas 20. Altogether, the inventive design of the target apparatus 10 increases the level of difficulty and skill in achieving at the end of regulation play a large number of perched bolas 20.

Accordingly, the object of bola toss games with the target apparatus 10 in accordance with the invention is for players to toss their bolas 20 such that they land and come to rest perched on the targeted rung-target 70 by the cord wrapping or draping around it. The rules of the game can be configured by assigning different point values to the different rungs 70. That way, players score points based upon the rung 70 on which their bolas 20 remain perched on at the end of a given round. FIG. 2 shows by way of non-limiting example that perhaps the top rung 70 on the rearward frame 40 is worth three points, the middle rung 70 thereof worth two, while the lowest rung 70 thereof worth only a single point. In contrast, the sole (top) rung 70 of the forward frame 30 (or hurdle) might be assigned a negative value (such as a subtraction of one point). Therefore, the forward frame 30 ("hurdle") is sort of an obstacle to be avoided.

What makes this game interesting is that, as shown better in FIG. 3, the rungs 70 have a free-spinning sleeve 72, that, when hit may fling the projectile off and either land on the ground or knock off an opposing player's already scored projectile. Also, preferably the balls of the bolas 20 are made of a hard rubber material so that the balls will bounce upon impact with anything:—eg., the other ball of the bola 20, any other balls of already perched bolas 20 or else the target apparatus 10 itself. That way, the bolas 20 have a life unto themselves and are barely controllable. So, if players are aiming for the top rung 70 worth three points, they risk that the extra energy put into throwing the bola 20 will cause the projectile to furiously wrap and unwrap itself and thereafter leap to about anywhere, including the undesirable penalty rung 70 on the forward ("hurdle") frame 30, which has a negative point value. Other possibilities include without limitation that a player takes aim at rung 70 which has none of that player's previously tossed bolas 20 already perched there, but the landing bola 20 furiously leaps from the target rung 70 to an un-targeted rung 70 and causes a previously-perched bola 20 of that player to fall to the ground, with the tossed bola 20 following suit. In consequence, this is not so much a situation of that player finding him or herself incurring penalty points but taking prospective points off the scoreboard.

But anything is possible. Perhaps a player aiming at the three-point rung 70 gets his or her bola 20 to perch there while at the same time flinging an opposing player's previously-perched bola 20 to the ground. Hence such a play results in a prospective six-point swing in the score.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. Target apparatus for a bola tossing game, comprising:

a pair of frames;

support structure to hold the frames upright and spaced one in front of the other along a line of sight from where users toss said bolas;

each frame comprising a pair of transversely-spaced upright stiles and at least one free-spinning rung-target extending between and carried at elevation by the respective pair of stiles of the respective frame with freedom to respond in particular to asymmetric landings of tossed bolas by accelerating to spinning rapidly along each's respective spin axis;

wherein said line-of-sight spacing between the frames changes the complexion of bola tossing games by adding a depth dimension to the rung-targets as said free-spinning rung-targets concurrently increase the level of difficulty and skill in perching bolas either wrapped or draped at rest on rungs by increasing the propensity of landing bolas to, in quick succession, wind fully in and then on rebound unwind and thereafter self-launch off the subject rung.

2. The target apparatus of claim 1 wherein:

said free-spinning rung-targets comprise outer sleeves and inner axles fixed to the stiles for the outer sleeves to be coupled free-spinning thereon.

3. The target apparatus of claim 2 wherein:

said inner axles and outer sleeves comprise Plastic tubes or pipes.

4. The target apparatus of claim 3 wherein:

said support structure comprises a generally horizontal framework for setting on a base support surface.

5. The target apparatus of claim 4 wherein:

said target apparatus is generally constructed of Plastic pipes or tubes which, except for the free-spinning outer sleeves, are rigidly interconnected by fittings comprising Tees and Ells.

6. The target apparatus of claim 5 wherein:

said free-spinning outer sleeves are closely bracketed between the spaced fittings that rigidly interconnect the respective axle disposed inside thereof to the respective pair of stiles therefor in order to restrict axial dislocation of said free-spinning outer sleeves.

7. The target apparatus of claim 1 wherein:

at least one of the frames carries a plurality of free-spinning rung-targets at diverse elevations.

8. A method of playing a bola tossing game comprising the step of supplying a target apparatus according to claim 1, and further comprising the steps of:

supplying opposing players with a plurality of bolas; and accumulating score based on bolas perched on rung-targets and determining a winning score after regulation play.

9. A method of playing a bola tossing game comprising the steps of:

supplying a target apparatus, comprising:

a pair of stiles, support structure to hold the stiles in spaced upright relation, a plurality of free-spinning rung-targets extending between the stiles at diverse elevations, and carried by the stiles with freedom to respond in particular to asymmetric landings of tossed bolas by accelerating to spinning rapidly along each's respective spin axis, wherein said free-spinning rung-targets increase the level of difficulty and skill in perching bolas either wrapped or draped at rest on rungs by not only increasing the propensity of landing bolas to, in quick succession, wind fully in and then on rebound unwind and thereafter self-launch off the subject rung but also by increasing the propensity that the foregoing dislodges any previously perched bola;

supplying opposing players with a plurality of bolas; and accumulating score based on bolas perched on rung-targets and determining a winning score after regulation play.

10. The method of claim 9 wherein:

said free-spinning rung-targets comprise outer sleeves and inner axles fixed to the stiles for the outer sleeves to be coupled free-spinning thereon.

11. The method of claim 10 wherein:

said inner axles and outer sleeves comprise Plastic tubes or pipes.

12. The method of claim 11 wherein:

said support structure comprises a generally horizontal framework for setting on a base support surface.

13. The method of claim 12 wherein:

said target apparatus is generally constructed of Plastic pipes or tubes which, except for the free-spinning outer sleeves, are rigidly interconnected by fittings comprising Tees and Ells.

14. The method of claim 13 wherein:

said free-spinning outer sleeves are closely bracketed between the spaced fittings that rigidly interconnect the respective axle disposed inside thereof to the respective pair of stiles therefor in order to restrict axial dislocation of said free-spinning outer sleeves.

* * * * *